US009586224B2

(12) United States Patent
Chen et al.

(10) Patent No.: US 9,586,224 B2
(45) Date of Patent: Mar. 7, 2017

(54) SLIT NOZZLE CLEANING DEVICE

(71) Applicant: SHENZHEN CHINA STAR OPTOELECTRONICS TECHNOLOGY CO., LTD., Shenzhen, Guangdong (CN)

(72) Inventors: Hui Chen, Guangdong (CN); Chih-Hao Chang, Guangdong (CN); Wen-Hua Wang, Guangdong (CN); Chi-Che Lin, Guangdong (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 17 days.

(21) Appl. No.: 14/111,796

(22) PCT Filed: Jul. 2, 2013

(86) PCT No.: PCT/CN2013/078711
§ 371 (c)(1),
(2) Date: Oct. 15, 2013

(87) PCT Pub. No.: WO2014/205872
PCT Pub. Date: Dec. 31, 2014

(65) Prior Publication Data

US 2016/0107184 A1 Apr. 21, 2016

(30) Foreign Application Priority Data

Jun. 28, 2013 (CN) ..... 2013 1 0269991

(51) Int. Cl.

| | |
|---|---|
| ***B08B 15/02*** | (2006.01) |
| ***B05B 15/02*** | (2006.01) |
| *B05C 5/02* | (2006.01) |
| *B05B 1/04* | (2006.01) |

(52) U.S. Cl.
CPC ..... *B05B 15/02* (2013.01); *B05B 15/0208* (2013.01); *B05B 15/0225* (2013.01); *B05B 1/044* (2013.01); *B05C 5/0208* (2013.01); *B05C 5/0254* (2013.01)

(58) Field of Classification Search
CPC . B05B 15/02; B05B 15/0208; B05B 15/0216; B05B 15/0225; B05B 15/0233
USPC ..... 15/93.1
See application file for complete search history.

(56) References Cited

FOREIGN PATENT DOCUMENTS

CN 102161027 A * 2/2011 ..... B05B 15/02

OTHER PUBLICATIONS

Computer generated English translation of CN 10216027 A, Feb. 2011, Takuo et al.*

* cited by examiner

*Primary Examiner* — Laura C Guidotti

(57) ABSTRACT

The present invention discloses a slit nozzle cleaning device, the slit nozzle cleaning device comprises a scraper for cleaning the slit nozzle and an auxiliary inserting means, wherein the auxiliary inserting means is configured to guide the scraper into the slit nozzle. With the aid of the auxiliary inserting means, the scraper can enter the slit nozzle smoothly and precisely without the risk of breaking.

5 Claims, 6 Drawing Sheets

SLIT NOZZLE CLEANING DEVICE

FIELD OF THE INVENTION

The present invention relates to a slit nozzle cleaning device, which is capable of cleaning the slit inner of the slit nozzle for coating photo resist in the photolithography process of LCD (Liquid crystal display) modules in particular.

BACKGROUND OF THE INVENTION

The statements in this section merely provide background information related to the present invention and may or may not constitute prior art.

In a photolithography process for manufacturing a semiconductor device such as TFT-LCD modules, photo resist is coated on a substrate by a slit nozzle generally. The slit nozzle has a slit outlet as a discharge opening for a coating fluid material. The slit nozzle moves above the substrate and applies the coating fluid material (such as colour filter resist) on the substrate. The colour filter resist usually contains pigments dispersed therein. On the other hand, the opening width of the slit outlet is usually small (about 100 microns). In coating process, the slit outlet may be blocked and thus the quality of coating will be affected adversely.

SUMMARY OF THE INVENTION

The present invention provides a slit nozzle cleaning device to solve the mentioned problem above.

The present invention is realized in such a way that: a slit nozzle cleaning device, comprising a scraper for cleaning the slit nozzle and an auxiliary inserting means, wherein the auxiliary inserting means is configured to guide the scraper into the slit nozzle.

According to an embodiment disclosed herein, the auxiliary inserting means is attached to the slit nozzle.

According to another embodiment disclosed herein, the slit nozzle comprises a left cover-plate, a right cover-plate, a front half, a rear half, a nozzle chamber, a fluid inlet and a slit outlet, the front half is connected with the rear half by the left cover-plate and the right cover-plate, the nozzle chamber and the slit outlet are formed between the front half and the rear half.

According to another embodiment disclosed herein, the fluid inlet is formed on the front half.

According to another embodiment disclosed herein, the auxiliary inserting means comprises an auxiliary inserting section and a join section, the auxiliary inserting section comprises an inserting section front portion and an inserting section rear portion, the inserting section front portion and the inserting section rear portion are joined together by the join section.

According to another embodiment disclosed herein, the auxiliary inserting means comprises a guiding gap formed between the inserting section front portion and the inserting section rear portion.

According to another embodiment disclosed herein, the slit nozzle cleaning device further comprises a flexible mounting bracket, the flexible mounting bracket comprises a plurality of coil springs for pushing the auxiliary inserting means upwards.

According to another embodiment disclosed herein, the auxiliary inserting means further comprises a plurality of magnets for attaching the auxiliary inserting means to the slit nozzle.

According to another embodiment disclosed herein, the guiding gap comprises a V-shaped space on the top, an inverted V-shaped space on the bottom and a fixed interval space between the V-shaped space and the inverted V-shaped space, the V-shaped space is configured to receive the slit outlet.

According to another embodiment disclosed herein, the opening width of the slit outlet is larger than the width of the fixed interval space.

According to another embodiment disclosed herein, the width of the fixed interval space is larger than the thickness of the scraper.

According to another embodiment disclosed herein, the slit nozzle cleaning device further comprises a scraper clamp, the scraper clamp is configured to clamp the scraper.

According to another embodiment disclosed herein, the slit nozzle cleaning device further comprises a clamp driving means, the clamp driving means is configured to drive the scraper clamp to move along left-right direction.

According to another embodiment disclosed herein, the slit nozzle comprises a left cover-plate, a right cover-plate, a front half, a rear half, a nozzle chamber, a fluid inlet and a slit outlet, the front half is connected with the rear half by the left cover-plate and the right cover-plate, the nozzle chamber and the slit outlet are formed between the front half and the rear half, the fluid inlet is formed on the front half, the auxiliary inserting means comprises an auxiliary inserting section and a join section, the auxiliary inserting section comprises an inserting section front portion and an inserting section rear portion, the inserting section front portion and the inserting section rear portion are joined together by the join section, the auxiliary inserting means comprises a guiding gap formed between the inserting section front portion and the inserting section rear portion.

According to another embodiment disclosed herein, the slit nozzle cleaning device further comprises a flexible mounting bracket, the flexible mounting bracket comprises a plurality of coil springs for pushing the auxiliary inserting means upwards.

According to yet another embodiment disclosed herein, the slit nozzle cleaning device further comprises a scraper clamp, the scraper clamp is configured to clamp the scraper.

According to the present invention, the slit nozzle cleaning device comprises a scraper for cleaning the slit nozzle and an auxiliary inserting means, the auxiliary inserting means is configured to guide the scraper into the slit nozzle. With the aid of the auxiliary inserting means, the scraper can enter the slit nozzle smoothly and precisely without the risk of breaking.

For more clearly and easily understanding above content of the present invention, the following text will take a preferred embodiment of the present invention with reference to the accompanying drawings for detail description as follows.

BRIEF DESCRIPTION OF THE DRAWINGS

The drawings described herein are for illustration purposes only and are not intended to limit the scope of the present disclosure in any way.

DETAILED DESCRIPTION OF PREFERRED EMBODIMENTS

The following detailed description of every embodiment with reference to the accompanying drawings is used to exemplify a specific embodiment, which may be carried out in the present invention. Directional terms mentioned in the present invention, such as "top", "bottom", "front", "rear", "left", "right", "upwards" etc., are only used with reference to the orientation of the accompanying drawings. Therefore, the used directional terms are intended to illustrate, but not to limit, the present invention. Also the following description is merely exemplary in nature and is not intended to limit the present disclosure, application, or uses.

Figure 1:
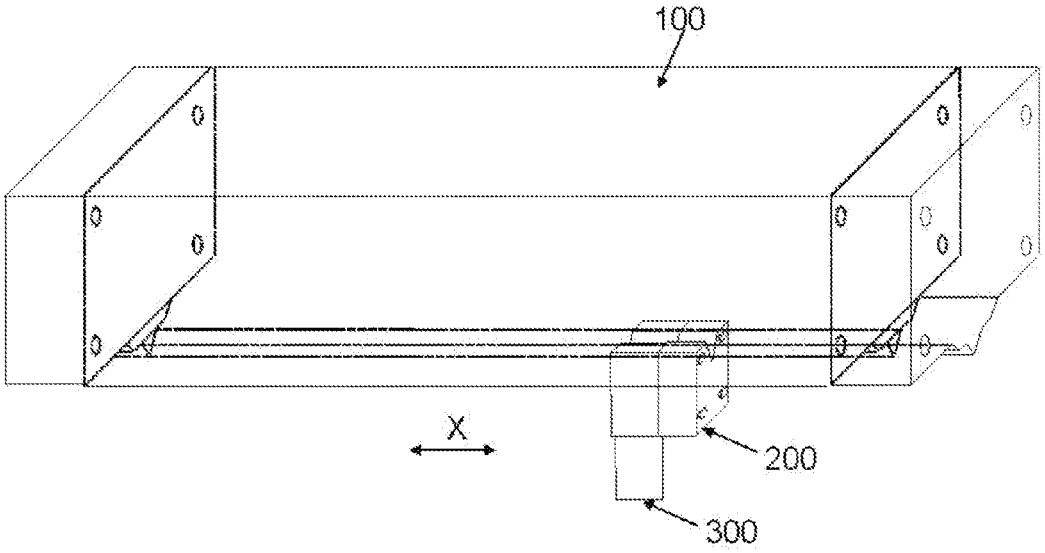
FIG. 1 is a schematic perspective view of a slit nozzle and the slit nozzle cleaning device according to an embodiment of the present invention.

The slit nozzle cleaning device according to the present invention comprises a sheet-like scraper 300 for cleaning the slit nozzle 100 and an auxiliary inserting means 200, as shown in FIG. 1. The auxiliary inserting means 200 is configured to guide the scraper 300 into the slit nozzle 100 (to be specific the slit outlet 112 of the slit nozzle 100).

Figure 4:
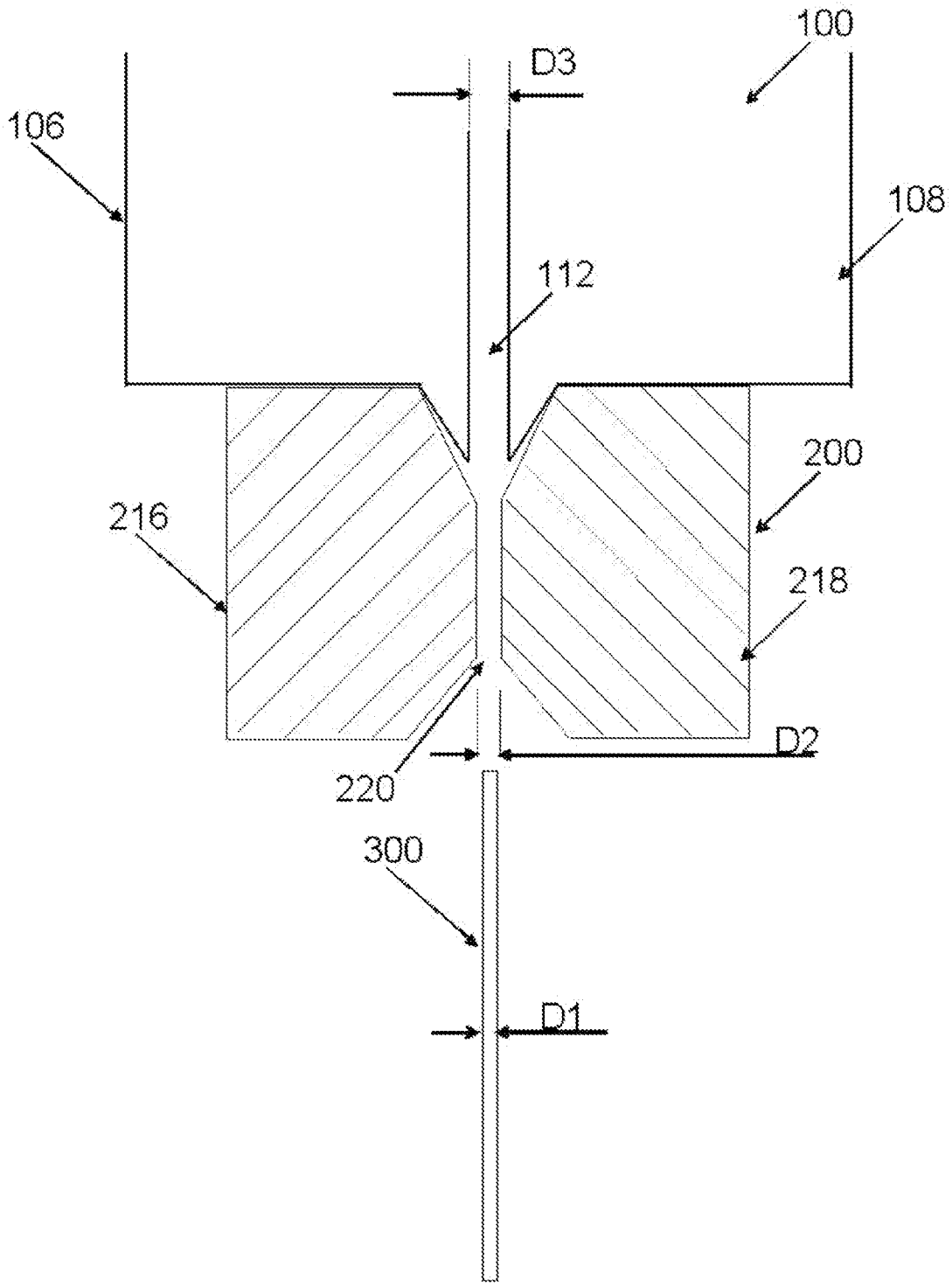
FIG. 4 shows the configurations of the slit outlet, the auxiliary inserting means and the scraper.
Figure 9:
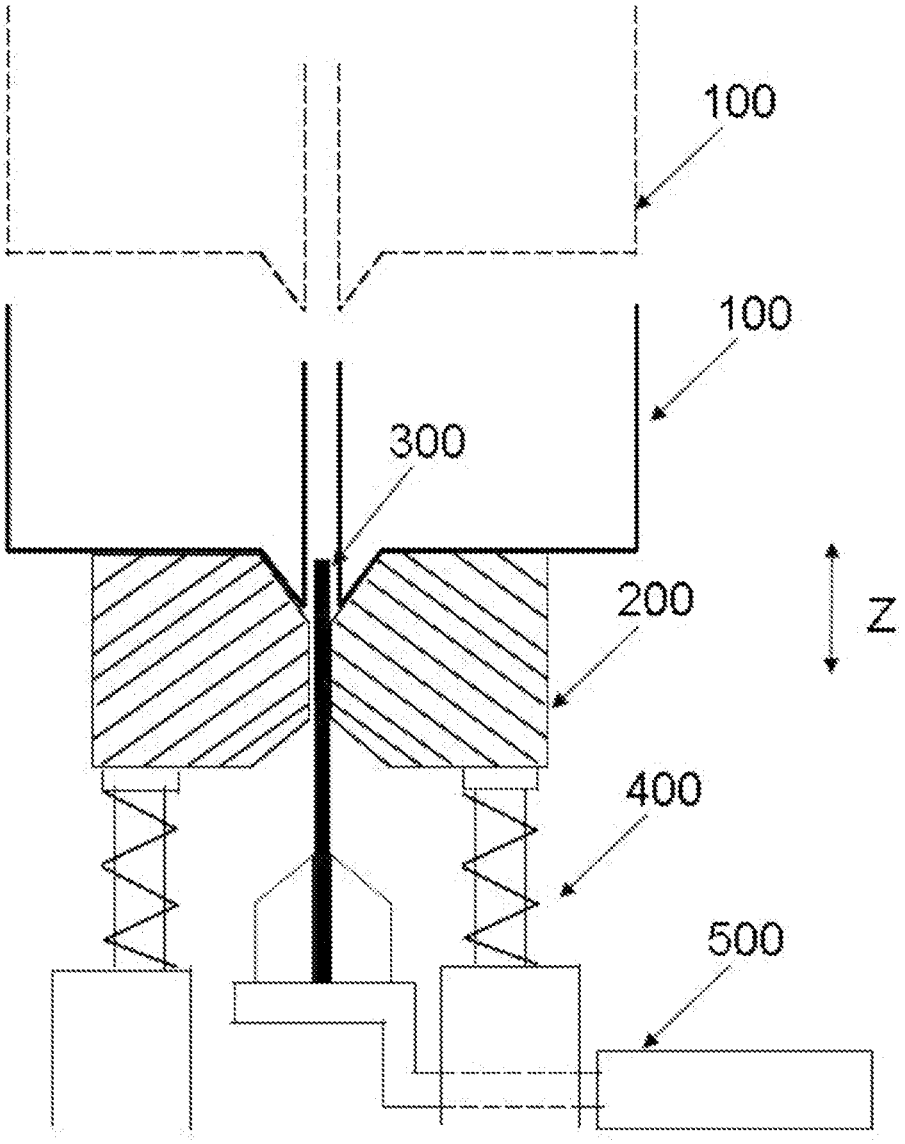
FIG. 9 shows the insertion process of the scraper using the slit nozzle cleaning device shown in FIG. 6.

The slit outlet 112 has a small opening width D3, as shown in FIG. 4. And the scraper 300 has a small thickness D1 correspondingly. The opening width D3 is larger than the thickness D1. The scraper 300 may be a sheet of PET (Polyethylene terephthalate) film. A part of the scraper 300 (the top portion of the scraper 300 in this embodiment) can be inserted into the slit outlet 112 with the aid of the auxiliary inserting means 200, as shown in FIG. 9. Then, the scraper 300 moves along left-right direction X and the scraper 300 scrape the slit inner (including interior walls especially) of the slit nozzle 100. Since the auxiliary inserting means 200 guide the scraper 300 into the slit outlet 112, the scraper 300 will enter the slit outlet 112 smoothly and precisely without the risk of breaking. Also, the depth of insertion of the scraper 300 into the slit outlet 112 also can be controlled by the auxiliary inserting means 200.

Figure 3:
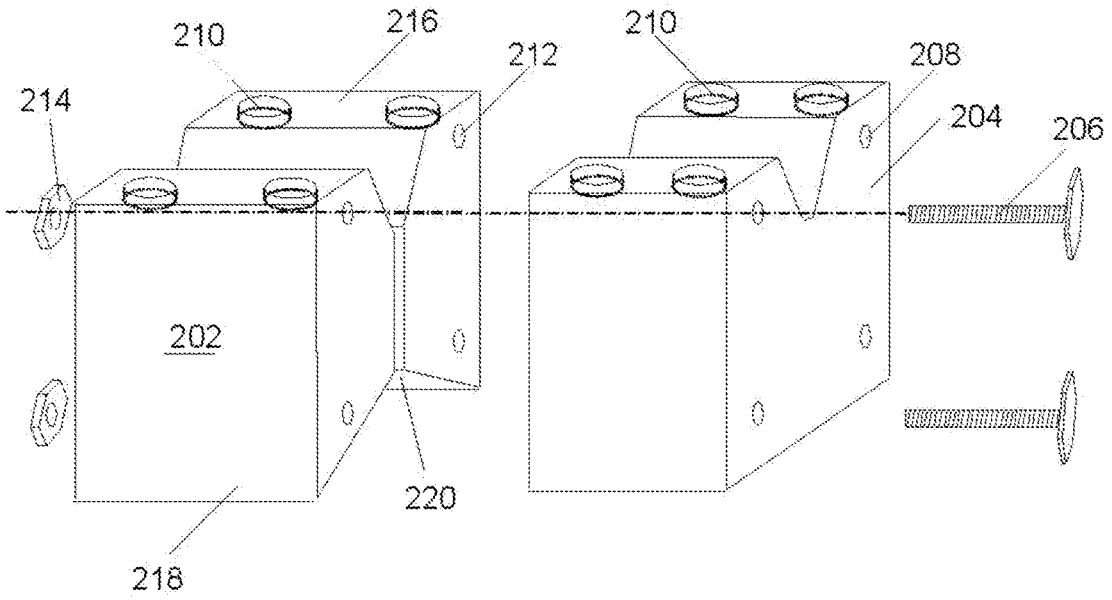
FIG. 3 is a schematic exploded view of the auxiliary inserting means in FIG. 1.

As shown in FIG. 3, the auxiliary inserting means 200 comprises an auxiliary inserting section 202 and a join section 204. The auxiliary inserting section 202 comprises an inserting section front portion 218 and an inserting section rear portion 216. The inserting section front portion 218 and the inserting section rear portion 216 are joined together by the join section 204. In particular, the inserting section front portion 218 is provided with two through holes 212, and the inserting section rear portion 216 is provided with two through holes 212. The join section 204 is provided with four through holes 208. Four bolts 206 (only two of them are shown in FIG. 3) are screwed into the through holes 208 and the through holes 212 and engaged with four nuts 214 respectively. Four bolts 206 extend along left-right direction X. In this way, the inserting section front portion 218 and the inserting section rear portion 216 are connected together securely.

In the embodiment of FIG. 1, the auxiliary inserting means 200 is attached to the slit nozzle 100 automatically. To be specific, the auxiliary inserting means 200 further comprises a plurality of magnets 210 for attaching the auxiliary inserting means 200 to the slit nozzle 100 as shown in FIG. 3. Since the slit nozzle 100 is made of steel, so the auxiliary inserting means 200 can attach on the bottom of the slit nozzle 100 automatically. Although the auxiliary inserting means 200 attach to the slit nozzle 100 by magnets, the auxiliary inserting means 200 attach to the slit nozzle 100 by adhesive tapes or the like.

Figure 2:
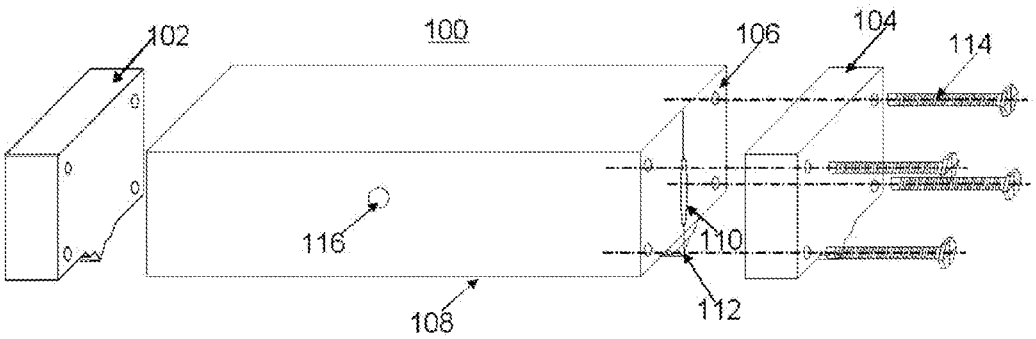
FIG. 2 is a schematic exploded view of the slit nozzle in FIG. 1.

As shown in FIG. 2, the slit nozzle 100 comprises a left cover-plate 102, a right cover-plate 104, a front half 108, a rear half 106, a nozzle chamber 110, a fluid inlet 116 and a slit outlet 112. The front half 108 is connected with the rear half 106 by the left cover-plate 102 and the right cover-plate 104. The nozzle chamber 110 and the slit outlet 112 are formed between the front half 108 and the rear half 106. The front half 108 and the rear half 106 are sandwiched together by the left cover-plate 102 and the right cover-plate 104. The front half 108, the rear half 106, the left cover-plate 102 and the right cover-plate 104 are fastened together by four elongate bolts 114, as shown in FIG. 2. In this embodiment, the fluid inlet 116 is formed on the front half 108. Photo resist can flow into the nozzle chamber 110 from the fluid inlet 116.

As described above, the inserting section front portion 218 and the inserting section rear portion 216 are joined together by the join section 204. And the auxiliary inserting means 200 comprises a guiding gap 220 formed between the inserting section front portion 218 and the inserting section rear portion 216, as shown in FIG. 3 through FIG. 5.

Figure 5:
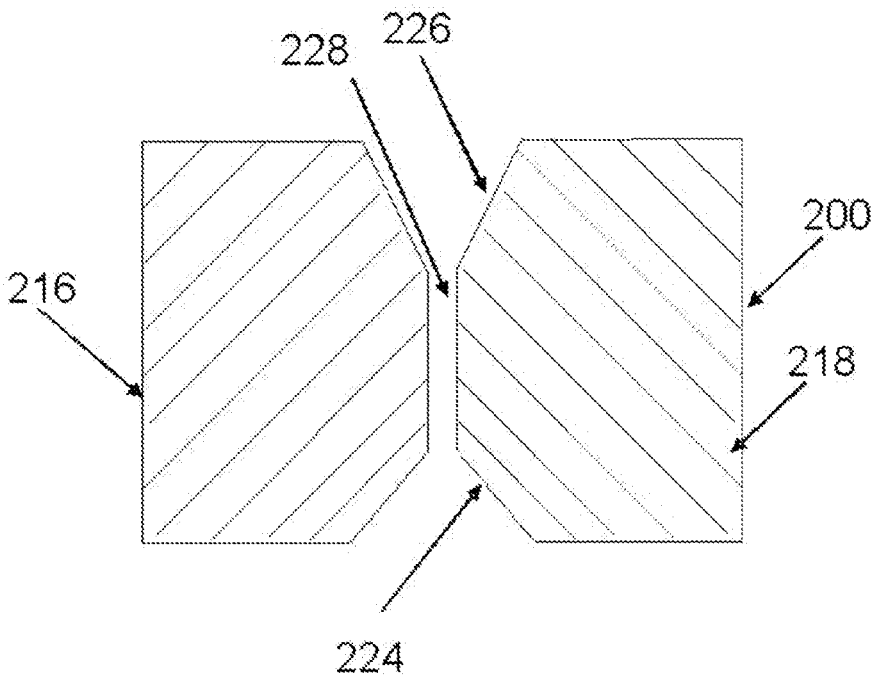
FIG. 5 shows the configuration of the guiding gap of the auxiliary inserting means.

Referring to FIG. 4 and FIG. 5, the guiding gap 220 comprises a V-shaped space 226 on the top, an inverted V-shaped space 224 on the bottom and a fixed interval space 228 between the V-shaped space 226 and the inverted V-shaped space 224. The V-shaped space 226 is configured to receive the slit outlet 112. As shown in FIG. 4, the profile of the slit outlet 112 is also V-shaped. The V-shaped space 226 mates with the protruding portion of the slit outlet 112. The opening width D3 of the slit outlet 112 is larger than the width D2 of the fixed interval space 228. The width D2 of the fixed interval space is larger than the thickness D1 of the scraper 300. Furthermore, the slit outlet 112, the fixed interval space 228 and the scraper 300 are aligned with each other in vertical direction Z. In this way, the scraper 300 may enter the slit outlet 112 smoothly and precisely. Also, the depth of insertion of the scraper 300 into the slit outlet 112 can be controlled by the auxiliary inserting means 200.

When the scraper 300 entered the slit outlet 112 by a predetermined depth, the scraper 300 can be driven to move along left-right direction X manually (by hand) or by a driving means so as to cleaning the inner side of the slit nozzle 100.

Now another embodiment of the slit nozzle cleaning device will be described with reference to FIG. 6 and FIG. 9. Compared with the embodiment shown in FIG. 1, the embodiment of the slit nozzle cleaning device shown in FIG. 6 further comprises a flexible mounting bracket 400, a scraper clamp 500 and a clamp driving means 504.

Figure 6:
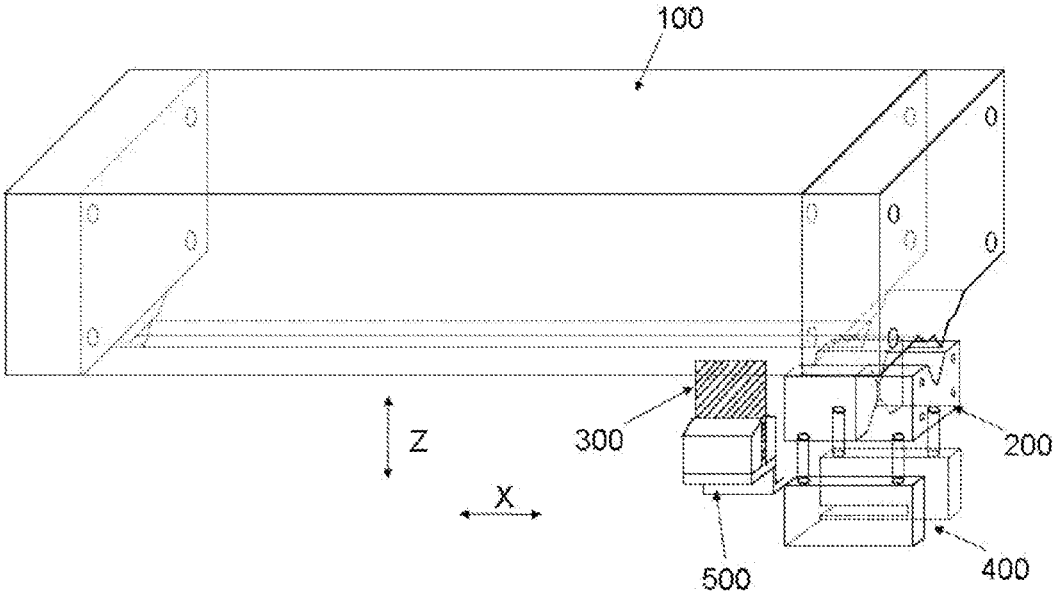
FIG. 6 is a schematic perspective view of a slit nozzle and the slit nozzle cleaning device according to another embodiment of the present invention.
Figure 7:
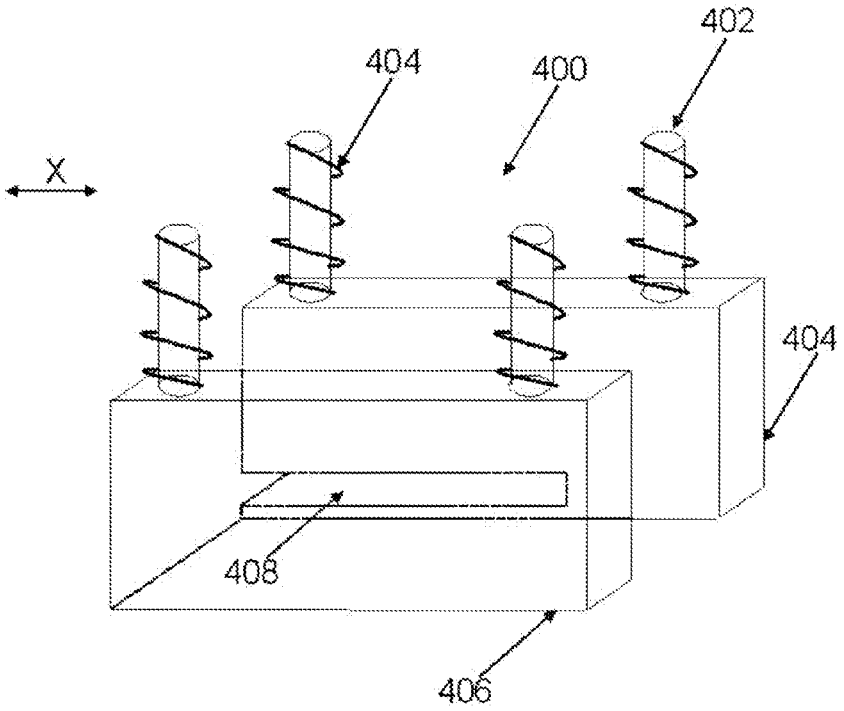
FIG. 7 is a schematic perspective view of the flexible mounting bracket in FIG. 6.
Figure 8:
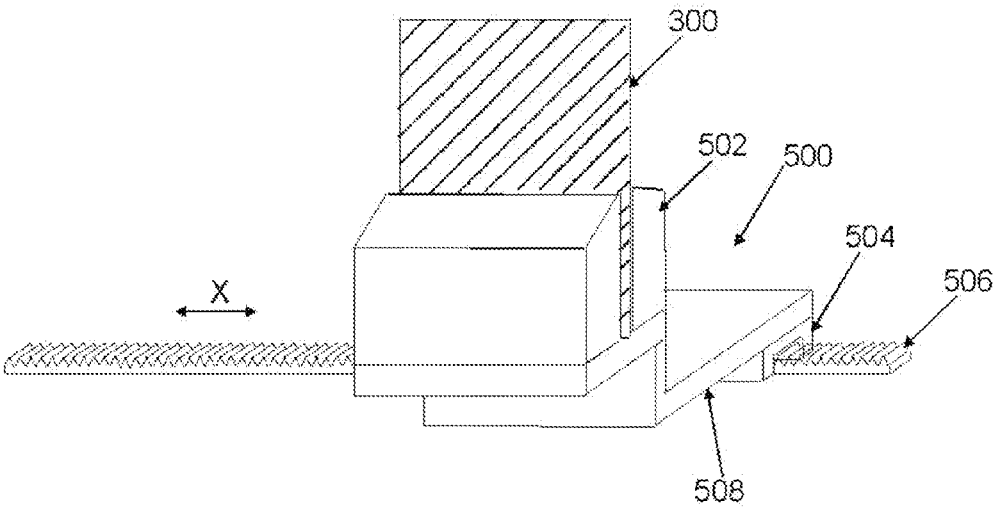
FIG. 8 is a schematic perspective view of the scraper clamp in FIG. 6.

As shown in FIG. 6 and FIG. 7, the flexible mounting bracket 400 comprises a front supporting block 406, a rear supporting block 404, and a recess 408. Moreover, the flexible mounting bracket 400 comprises a plurality of coil springs 404 for pushing the auxiliary inserting means 200 upwards (along vertical direction Z). The front supporting block 406 and the rear supporting block 404 are provided with four columns 402 on the top surface, and the columns 402 fits into the coil springs 404 respectively. Under the action of the flexible mounting bracket 400, the auxiliary inserting means 200 may abut against the slit nozzle 100 all the time in cleaning process. Also, under the action of coil springs 404, the auxiliary inserting means 200 may move slightly along vertical direction Z.

As shown in FIG. 6 through FIG. 9, the scraper clamp 500 is configured to clamp the scraper 300. The clamp driving means 504 is configured to drive the scraper clamp 500 to move along left-right direction X. In this way, the scraper 300 moves along left-right direction X automatically and clean the slit inner at the same time. The scraper clamp 500 comprises a jaw 502, an extending plate 508 and a rack 506. The jaw 502 comprises a front clamping plate and a rear clamping plate. The front clamping plate cooperates with the rear clamping plate to clamp the scraper 300. In one embodiment, the front clamping plate, the scraper 300 and the rear clamping plate are fastened together by multiple bolts. The jaw 502 is fixed on the extending plate 508. The extending plate 508 penetrates through the recess 408 and connects with the clamp driving means 504. The clamp driving means 504 may be a motor for driving a gear. The gear driven by the clamp driving means 504 is engaged with the rack 506. Under the action of the clamp driving means 504, the scraper clamp 500 and the scraper 300 moves along left-right direction X. Therefore, the slit nozzle 100 can be cleaned efficiently.

In an illustrative operation of the slit nozzle cleaning device, firstly the scraper 300 is mounted on the scraper clamp 500. Then the auxiliary inserting means 200 is aligned with the slit nozzle 100, the slit nozzle 100 moves towards the auxiliary inserting means 200. Finally the scraper 300 is inserted into the slit outlet 112 at a predetermined depth. In this embodiment, with the aid of the flexible mounting bracket 400 and the V-shaped space on the top, the auxiliary inserting means 200 can align with the slit nozzle 100 automatically. Moreover, the auxiliary inserting means 200 has degree of freedom along vertical direction Z.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the 3 particular embodiment disclosed, but that the present invention will include all embodiments falling within the scope of the appended claims.

What is claimed is:

1. A slit nozzle cleaning device, comprising a scraper for cleaning the slit nozzle and an auxiliary inserting means, wherein the auxiliary inserting means is configured to guide the scraper into the slit nozzle, wherein the auxiliary inserting means is attached to the slit nozzle, wherein the auxiliary inserting means comprises an auxiliary inserting section and a join section, the auxiliary inserting section comprises an inserting section front portion and an inserting section rear portion, the inserting section front portion and the inserting section rear portion are joined together by the join section, wherein the auxiliary inserting means comprises a guiding gap formed between the inserting section front portion and the inserting section rear portion, wherein the guiding gap comprises a V-shaped space on the top, an inverted V-shaped space on the bottom and a fixed interval space between the V-shaped space and the inverted V-shaped space, the V-shaped space is configured to receive a slit outlet of the slit nozzle.

2. The slit nozzle cleaning device of claim 1, wherein the width of the fixed interval space is smaller than the opening width of the slit outlet.

3. The slit nozzle cleaning device of claim 2, wherein the width of the fixed interval space is larger than the thickness of the scraper.

4. A slit nozzle cleaning device, comprising a scraper for cleaning the slit nozzle and an auxiliary inserting means, wherein the auxiliary inserting means is configured to guide the scraper into the slit nozzle, wherein the auxiliary inserting means is attached to the slit nozzle, wherein the auxiliary inserting means comprises an auxiliary inserting section and a join section, the auxiliary inserting section comprises an inserting section front portion and an inserting section rear portion, the inserting section front portion and the inserting section rear portion are joined together by the join section, wherein each of the inserting section front portion, the inserting section rear portion and the section each is provided with a plurality of through holes, bolts are screwed into the through holes and engaged with nuts respectively, thereby joining the inserting section front portion together with the inserting section rear portion.

5. A slit nozzle cleaning device, comprising a scraper for cleaning the slit nozzle and an auxiliary inserting means, wherein the auxiliary inserting means is configured to guide the scraper into the slit nozzle, wherein the auxiliary inserting means is attached to the nozzle, wherein the auxiliary inserting means comprises an auxiliary inserting section and a join section, the auxiliary inserting section comprises an inserting section front portion and an inserting section rear portion, the inserting section front portion and the inserting section rear portion are connected together securely by the join section, wherein each of the inserting section front portion, the inserting section rear portion and the join section each is provided with a plurality of through holes, bolts are screwed into the through holes and engaged with nuts respectively, thereby connecting the inserting section front portion together with the inserting section rear portion.

* * * * *